US006276164B1

(12) United States Patent
Santa Cruz et al.

(10) Patent No.: US 6,276,164 B1
(45) Date of Patent: Aug. 21, 2001

(54) ICE CHEST WRAP

(76) Inventors: Cathy D. Santa Cruz, 7630 Tholl Dr., Reno; Richard A. Corron, Sr., 908 Horizon Ct., Sparks, both of NV (US) 89506

( * ) Notice: Subject to any disclaimer, the term of this patent is extended or adjusted under 35 U.S.C. 154(b) by 0 days.

(21) Appl. No.: 09/493,821

(22) Filed: Jan. 28, 2000

(51) Int. Cl.[7] ..... F25D 3/08
(52) U.S. Cl. ..... 62/457.7; 62/372; 62/530
(58) Field of Search ..... 62/457.7, 457.4, 62/530, 372; 220/903

(56) References Cited

U.S. PATENT DOCUMENTS 4,514,993 * 5/1985 Johnson ..... 62/372
4,802,344 * 2/1989 Livingston et al. ..... 62/372
5,251,460 * 10/1993 DeMarco et al. .
5,313,809 * 5/1994 Isaacson et al. ..... 62/530
5,361,605 * 11/1994 Pizzi et al. ..... 62/530
5,564,568 * 10/1996 Rankin, Sr. ..... 62/372 X
5,680,944 * 10/1997 Rueter ..... 220/903 X
5,709,105 * 1/1998 Palermo ..... 62/457.4
5,934,100 * 8/1999 Hornick ..... 62/457.4
6,036,047 * 3/2000 Dobbie ..... 220/903 X
6,079,316 * 6/2000 Barden et al. .
6,082,896 * 7/2000 Pulli ..... 62/372 X

* cited by examiner

*Primary Examiner*—Michael Powell Buiz
*Assistant Examiner*—Chen Wen Jiang

(57) ABSTRACT

An accessory item that is used in combination with a pre-existing ice chest for providing increased insulation in a manner which reduces ice melt time, with the item being in the form of an adjustable wrap which is of a shape and size to fit various sized ice chests of user choice.

3 Claims, 2 Drawing Sheets

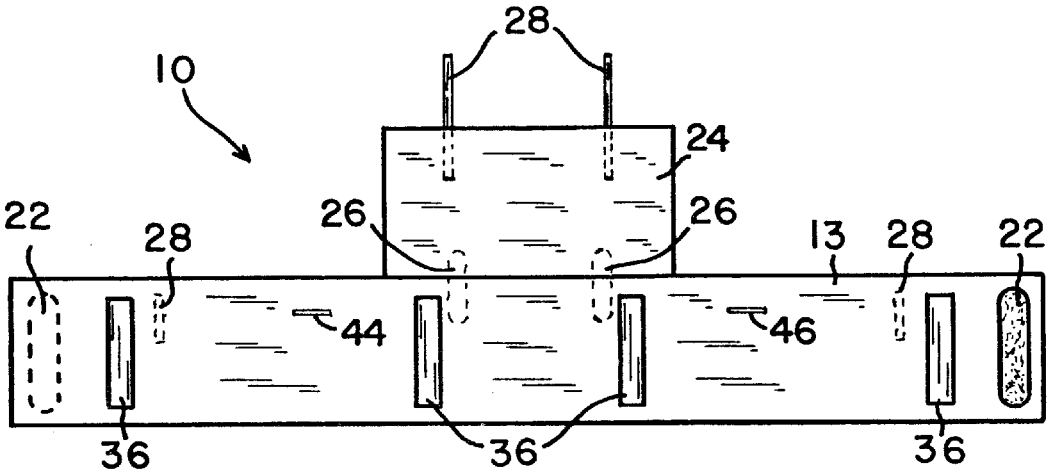
FIG. 2
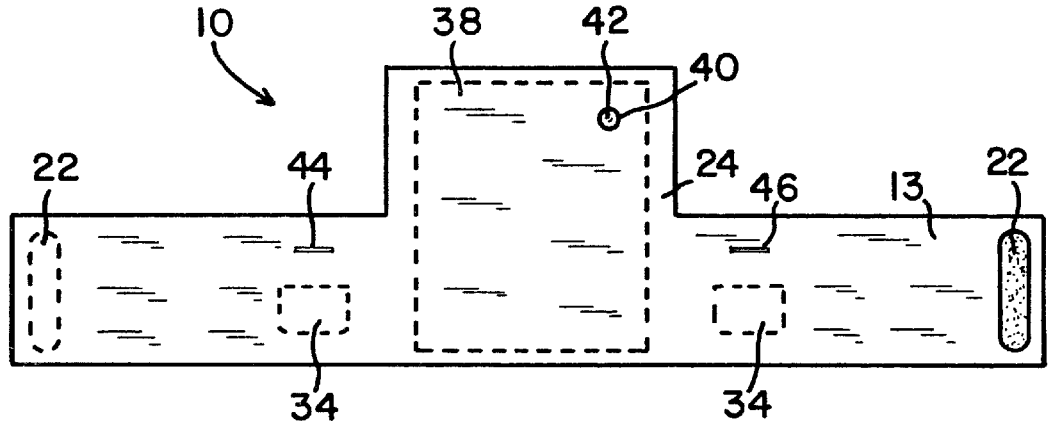
FIG. 3
FIG. 4
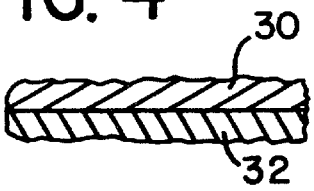

ICE CHEST WRAP

FIELD OF THE INVENTION

The present invention relates to accessory items used in connection with ice chests, or the like. But more particularly relates to an insulated wrap which is attachable to a pre-existing ice chest and provides additional insulation.

BACKGROUND OF THE INVENTION

Ice chests or coolers are well known for keeping food or beverages cold, and insulation of some type is commonly used in the manufacturing process. However, most ice chests even though insulated, would be much more efficient if additional insulation were available. Thus, if the consumer were to have an insulated wrap that was removably attachable to the pre-existing ice chest, the insulation properties of the ice chest would be enhanced.

Various types of insulated wraps have been taught within the prior art. However, such wraps are only designed for use with a specific item. For example, taught within U.S. Pat. No. 5,361,605 entitled "BEVERAGE KEG INSULATED COOLING JACKET", they provide an exterior insulated wrap which is removably attachable to a beverage keg. This device is very functional for its intended use but it could not be used in connection with an ice chest, as taught within the present invention.

Other examples include U.S. Pat. Nos. 5,709,105 and 4,989,418, wherein each are specifically used in connection with a beverage container. Again, these devices are very functional for use with a beverage container, but they could not be used on an ice chest, or the like.

SUMMARY OF THE PRESENT INVENTION

It is therefore a primary object of the present invention to provide an insulated wrap which is of a shape and size to be removably adjustably attached onto a pre-existing portable ice chest, or cooler.

It is another object of the present invention to provide an ice chest wrap that is of a shape and size to fit substantially any ice chest of user choice.

Still another object of the present invention is to provide an ice chest wrap which includes adjustable attachment means for attaching the wrap to the ice chest.

Also an object of the present invention is to provide an ice chest wrap which includes a lid.

Yet a further object of the present invention is to provide an ice chest wrap which allows the user to easily open the ice chest even when the wrap is in place.

Still another object of the present invention is to provide an ice chest wrap which is made from an insulated material of engineering choice, such as HALOFIL, or the like.

Also another object of the present invention is -to provide an ice chest wrap which may be made from an aluminized outer shell which reflects the heat radiated from the sun.

Yet another object of the present invention is to provide an ice chest wrap which may include pockets thereon for containment of various articles according to engineering choice.

Also another object of the present invention is to provide an ice chest wrap which may include compartments for containment of frozen gel inserts.

Still another object of the present invention is to provide an ice chest wrap which may include a fill hole for receiving a fluid therein, such as a water-alcohol mixture. Thus, if desired, the ice chest wrap may be frozen prior to use, yet the wrap remains flexible as the alcohol will not freeze.

Other objects and advantages will be seen when taken into consideration with the following drawings and specification.

BRIEF DESCRIPTION OF THE DRAWINGS

FIG. 2 is substantially an overview of the present invention when in an open position.

FIG. 3 is substantially an overview of another embodiment for the present invention.

FIG. 4 is substantially a partial view showing insulation.

DETAILED DESCRIPTION OF THE DRAWINGS

Figure 1:
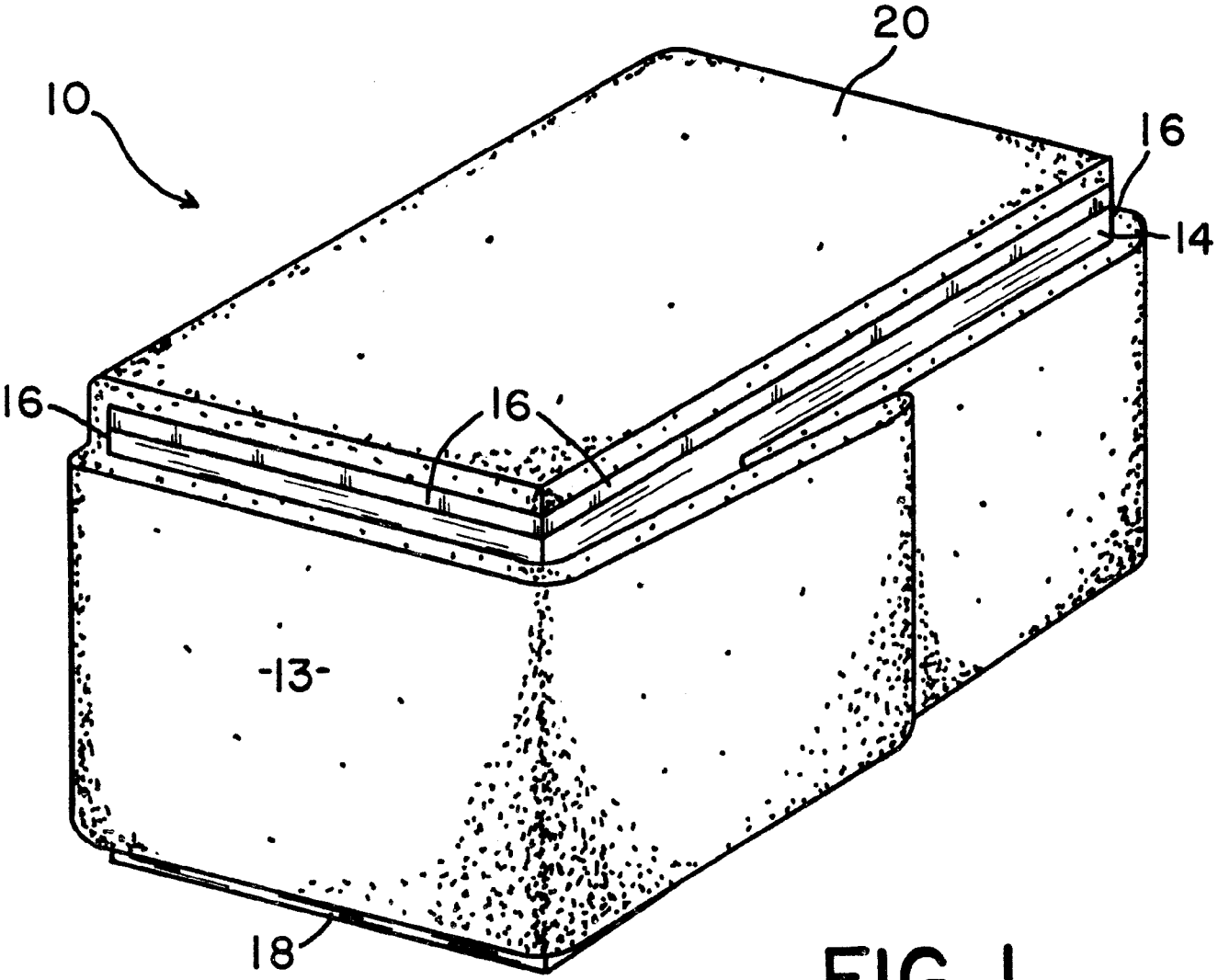
FIG. 1 is substantially a perspective overview of the present invention when attached to an ice chest.

Referring now in detail to the drawings wherein like characters refer to like elements throughout the various views.

In FIG. 1, (arrow 10) substantially represents an overview of the present invention which is an ice chest wrap in the form of an elongated flexible member (13), and is to be used in connection with a pre-existing ice chest (14). It is to be understood that any suitable ice chest (14) of user choice may be used, respectively. With ice chest (14) having four interconnected side walls (16), a bottom (18) and a lid (20).

In the preferred embodiment, member (13) is made from an insulated material of engineering choice, such as from HALOFIL (32), or the like. Also, member (13) is of a shape and size to be wrapped completely around the exterior surface of four side walls (16), as illustrated in FIG. 1.

Member (13) further includes attachment means for removably securing member (13) onto ice chest (14). It is to be understood any suitable attachment means of engineering choice may be used, such as a zipper, snaps, buttons, etc. Or as shown in FIGS. 2 & 3, attachment means may be in the form of a loop and pile fastener, such as VELCRO (22). Furthermore, if preferred member (13) may include a flap (24) which is of a shape and size to cover the exterior surface of lid (20) and allows the user to easily open or close lid (20). It is to be noted flap (24) and member (13) may be integrally formed in combination, as illustrated in FIG. 3. Or if preferred, flap (24) may be removably adjustably attached to member (13) by any suitable attachment means of engineering choice. Such as by VELCRO (26) as illustrated in FIG. 2. Also, if preferred flap (24) may include attachment means of engineering choice for removably adjustably attaching flap (24) to member (13). Such as VELCRO (28), as illustrated in FIG. 2.

It is to be noted if desired, member (13) and/or flap (24) may include an aluminized outer shell (30) (see FIG. 4) which reflects heat radiated from the sun. It is to be understood shell (30) can be formed integrally with insulation, such as HALOFIL (32) or each can be manufactured separately, respectively.

Also, as shown in FIG. 2, member (13) may include at least one pocket (34) which is used for storing an article of user choice, such as eating utensils, or the like, . Or if preferred, member (13) may include at least one compartment (36) which may be used for containment of frozen gel inserts, not shown as they are well known within the prior art.

Furthermore, if desired member (13) may include an internal water-proof compartment (38) which is used for containment of a liquid mixture of user choice. Such as water, or as the applicants prefer, a water and alcohol mixture combined, such as 3 parts water to 1 part alcohol.

Thus member (13) can be stored in a freezer until needed for use, yet member (13) even when in the freezer, will remain somewhat flexible as the alcohol will not freeze. This unique combination makes a nice slushy mixture and allows member (13) to remain flexible for easily attaching member (13) onto ice chest (14).

Furthermore, if the above embodiment is to be used, then member (13) also includes a fill hole (40) with sealing means for sealing fill hole (40), and fill hole (40) and compartment (38) are in open communication. It is to be noted any suitable type of sealing means of engineering choice may be used, such as a reusable plug (42), or the like.

It is to be noted most ice chests (14) also include a first external handle and a second external handle, with the first handle being substantially opposed to the second handle. Therefore if desired, member (13) may further include a first opening (44) and a second opening (46). With the first opening (44) being substantially opposed to second opening (46) when member (13) is attached to ice chest (14), and the first opening (44) being of a shape and size to receive first handle there through, and second opening (46) being of a shape and size to receive second handle there through.

It is to be understood, the present invention further includes a method of using an ice chest wrap (arrow 10), comprising of the following steps:

a. obtaining an ice chest (14) having four interconnected side walls (16), a bottom (18) and a lid (20);

b. grasping an ice chest wrap (arrow 10) which is formed from an elongated member (13), and member (13) having attachment means such as VELCRO (22) for removably securing member (13) onto ice chest (14);

c. wrapping ice chest wrap (arrow 10) completely around the exterior surface of four side walls (16) of ice chest (14); and;

d. closing attachment means VELCRO (22).

It is to be understood, if the embodiment as depicted in FIG. 2 is to be used, then the method steps include the following:

a. obtaining an ice chest (14) having four interconnected side walls (16), a bottom (18) and a lid (20);

b. grasping an ice chest wrap (arrow 10) which is formed from an elongated member (13), member (13) having a flap (24) which is of a shape and size to cover lid (20) respectively, and member (13) having attachment means such as VELCRO (22) for removably securing member (13) onto ice chest (14);

c. wrapping ice chest wrap (arrow 10) completely around the exterior surface of four side walls (16) of ice chest (14);

d. closing attachment means VELCRO (22);

e. positioning flap (24) on top of lid (20); and;

f. securing flap (24) in position using VELCRO (28) on top of lid (20).

It is to be understood, if the embodiment as depicted in FIG. 3 is to be used, then the method steps include the following:

a. grasping an ice chest wrap (arrow 10) which is formed from an elongated member (13), member (13) includes an internal water-proof compartment (32) which is used for containment of a liquid mixture, member (13) having a fill hole (40) with sealing means such as a plug (42) for sealing fill hole (40), member (13) having a flap (24) which is of a shape and size to cover lid (20) on ice chest (14), and member (13) having attachment means such as VELCRO (22) for removably securing member (13) onto ice chest (14);

b. locating fill hole (40) on said member (13);

c. removing sealing means, such as plug (42);

d. pouring a liquid mixture into fill hole (40) until full, respectively;

e. sealing fill hole (40) with plug (42);

f. inserting member (13) into a freezer until member (13) is to be used;

g. obtaining an ice chest (14) having four interconnected side walls (16), a bottom (18) and lid (20);

h. removing member (13) from the freezer;

i. wrapping member (13) completely around the exterior surface of four side walls (16) of ice chest (14);

j. closing attachment means, such as VELCRO (22);

k. positioning flap (24) on top of lid (20); and;

l. securing flap (24) in position using attachment means VELCRO (28) on top of lid (20).

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and wish to secure by Letters Patent is:

1. An ice chest wrap comprising: an elongated flexible member which is used in connection with a pre-existing ice chest, said ice chest having four interconnected side walls, a bottom, a lid, and a first and a second handle, said member being made from an insulated material and an aluminized outer shell in combination, said member being of a shape and size to be wrapped completely around the exterior surface of said four side walls, said member having a flap which is of a shape and size to cover said lid, said member with said flap being integrally formed in combination, said member having a first opening and a second opening, said first opening being of a shape and size to receive said first handle there through, said second opening being of a shape and size to receive said second handle there through, said member having at least one pocket used for storing an article, and said member having attachment means for removably securing said member onto said ice chest.

2. An ice chest wrap comprising: an elongated flexible member which is used in connection with a pre-existing ice chest, said ice chest having four interconnected side walls, a bottom and a lid, said member being made from an insulated material, said member being of a shape and size to be wrapped completely around the exterior surface of said four side walls, and said member having attachment means for removably securing said member onto said ice chest, said member having an internal water-proof compartment which is used for containment of a liquid mixture made from water and alcohol in combination, said member having a fill hole with a reusable plug for sealing said fill hole, and said fill hole and said compartment being in open communication.

3. A method of using an ice chest wrap comprising of the following steps:

a. grasping an ice chest wrap which is formed from an elongated member, said member includes an internal water-proof compartment which is used for containment of a liquid mixture, said member having a fill hole with sealing means for sealing said fill hole, said member having a flap which is of a shape and size to cover a lid on an ice chest, and said member having attachment means for removably securing said member onto said ice chest;

b. locating said fill hole on said member;

c. removing said sealing means;

d. pouring a liquid mixture into said fill hole until full;

e. sealing said fill hole;

f. inserting said member into a freezer until said member is to be used;

g. obtaining said ice chest, said ice chest having four interconnected side walls, a bottom and said lid;

h. removing said member from said freezer;

i. wrapping said member completely around the exterior surface of said four side walls of said ice chest;

j. closing said attachment means;

k. positioning said flap on top of said lid; and;

l. securing said flap in position on top of said lid.

* * * * *